United States Patent [19]

Landers, Jr. et al.

[11] Patent Number: 4,748,449

[45] Date of Patent: May 31, 1988

[54] RF ABSORBING ABLATING APPARATUS

[75] Inventors: James F. Landers, Jr., Tempe; R. Gordon Graham, Mesa; Theodore Harp, III, Scottsdale, all of Ariz.

[73] Assignee: Motorola, Inc., Schaumburg, Ill.

[21] Appl. No.: 595,868

[22] Filed: Apr. 2, 1984

[51] Int. Cl.[4] ..... H01Q 17/00

[52] U.S. Cl. ..... 343/705; 343/872; 342/4; 342/1

[58] Field of Search ..... 343/18 A, 708, 710, 343/712, 705, 873, 872; 428/920; 342/1, 2, 4

[56] References Cited

U.S. PATENT DOCUMENTS

| | | | |
|---|---|---|---|
| 3,187,331 | 6/1965 | Beller | 343/18 E |
| 3,277,488 | 10/1966 | Hoffman | 343/708 X |
| 3,579,242 | 5/1971 | Grantham | 343/708 |
| 4,006,479 | 2/1977 | LaCombe | 343/18 A |
| 4,347,487 | 8/1982 | Martin | 333/243 |

*Primary Examiner*—T. H. Tubbesing
*Assistant Examiner*—Mark Hellner
*Attorney, Agent, or Firm*—Maurice J. Jones; Eugene A. Parsons; Raymond J. Warren

[57] ABSTRACT

A microwave absorbing ablating material is used as the ablative covering between the transmitting and receiving antennas while a standard ablating material, allowing the transmission of signals, is placed about the antennas. This allows signals to be transmitted from and received by the object covered by RF absorbing ablating material while preventing the transmission of signals transversely through the material. The RF absorbing, ablating material is made by combining an RF absorbing material with an ablating material in sufficient quantities to absorb and dissipate any signals that may be exposed to the ablative material.

5 Claims, 1 Drawing Sheet

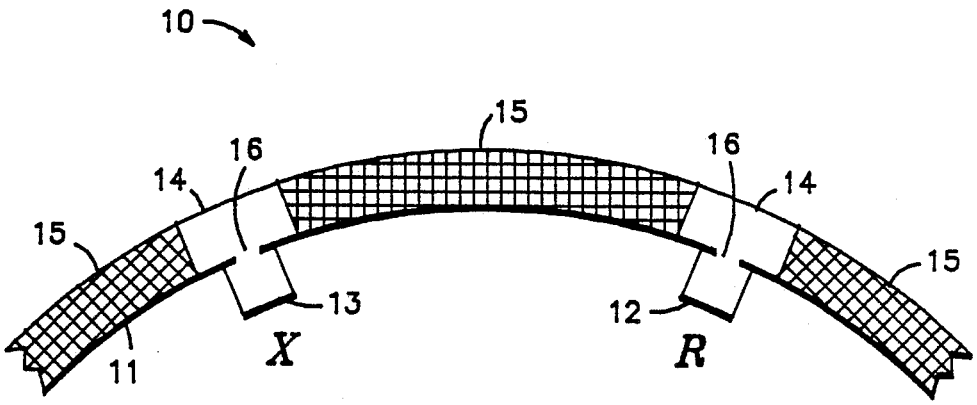
10
15
16
16
14
14
15
15
13
12
11
X
R

RF ABSORBING ABLATING APPARATUS

BACKGROUND OF THE INVENTION

1. Field of the Invention

This invention relates, in general, to an RF absorbing apparatus, and more particularly, to an RF absorbing ablating apparatus.

2. Description of the Background

Ablators and RF absorbers are known in the art, but an RF absorbing ablator has never been developed. A need for this type of material has risen from the increased speed of airborne vehicle. Previously no ablative type covering was required to protect the interior components from the excessive heat caused by the speed of the vehicle. As the speed of the vehicle increases the heat generated from the air friction also increases. The increased heat made it necessary to add an ablative material to the exterior of the vehicle to protect the inner components. This resulted in a problem with transmitting and receiving signals to and from the vehicle. The ablative coating would transversely transmit portions of the signals being transmitted to the receiving antenna, causing erroneous signals to be received.

SUMMARY OF THE INVENTION

Accordingly, it is an object of the present invention to provide an ablative material that will not transversely transmit RF signals.

Yet another object of the present invention is to provide a material that will allow control of RF energy attentuation.

Still another object of the present invention is to provide an RF absorbing, ablating material that is flexible, allowing it to be shaped.

The above and other objects and advantages of the present invention are provided by an RF absorbing ablative apparatus.

A particular embodiment of the present invention comprises an apparatus for absorbing RF signals that will also act as an ablator. An ablative material is combined with an RF absorbing material to form the resulting RF absorbing ablative material. The material is placed in sheets between the RF antennas to prevent signals from travelling through the ablative material between the transmit and receive antennas. Placed directly above each antenna is the standard ablative material so as not to disturb signals being transmitted from or to the airborne vehicle.

BRIEF DESCRIPTION OF THE DRAWINGS

FIG. 1 is a partial cross-sectional view of an antenna body embodying the present invention.

DETAILED DESCRIPTION OF THE INVENTION

Referring now to FIG. 1 a partial cross-section of an arcuate antenna body, generally designated 10, embodying the present invention is illustrated. While FIG. 1 shows an arcuate body it is to be understood that the following discussion will apply to any type of body of any shape. Two waveguides are shown attached to the interior of a body 11, a receiving (R) waveguide 12 and a transmitting (X) waveguide 13. While FIG. 1 illustrates antenna body 10 as having receiving and transmitting waveguides 12 and 13, it is to be understood that the present invention will operate with a single waveguide (either transmitting or receiving) or without any waveguides. At the points where waveguide 12 (13) contacts body 11 there is a gap 16 which allows the reception (transmission) of signals through body 11. Coating the exterior of body 11 is a non-RF absorbing, ablating material 14 and an RF absorbing, ablating material 15. Material 15 is located on the exterior of body 11 between the non-RF absorbing, ablating materials 14. Non-RF absorbing, ablating material 14 is located on body 11 opposite waveguides 12 and 13 covering gaps 16. This allows a window for the transmission and reception of signals without interference from RF absorbing, ablating material 15. RF absorbing, ablating material 15 prevent signals that are being transmitted from waveguide 13 from being transmitted transversely through non-RF absorbing, ablating material 14 and received by waveguide 12. The signals that are transmitted transversely into RF absorbing, ablating material 15 are absorbed and dissipated by the material. This results in a minimum amount of RF leakage which provides optimization of antenna design relative to transmit-receive isolation.

The concentration of RF absorbing material used in material 15 is varied depending on the required application. Having too large a concentration of RF absorbing material will result in an RF absorbing, ablating material that will be brittle and difficult to shape. Using a light concentration of RF absorbing material will result in signals being allowed to pass through the RF absorbing, ablating material 15. Tests have been run on RF absorbing, ablating materials having concentrations of RF absorbing material of 30% to 80%. These tests show drops of 50 dB to 100 dB in the transmitted signal. As a result, any concentration of RF absorbing material may be used depending on the desired result.

An example of the ablating material that is mixed with the RF absorbing material, to make the RF absorbing, ablator 15, and used for the non-RF absorbing, ablator 14 is ethylenetetrofluoroethylene (ETFE) such as manufactured by DuPont, Inc. under the name Tefzel.

The RF absorbing, ablating material lends itself to different manufacturing techniques (such as compression and injection molding and extrusion) and can be easily machined and worked. These characteristics allow the material to be made into any shape or form desired.

Thus, it is apparent that there has been provided, in accordance with the invention, a device and method that fully satisfies the objects, aims and advantages set forth above.

It has been shown that the present invention provides an RF absorbing ablative material that will prevent the transverse transmission of RF signals through the ablative material. Further, it has been shown that this material allows adjustable attentuation of RF energy through differing concentrations of the RF absorbing material in the RF absorbing ablator.

While the invention has been described in conjunction with specific embodiments thereof, it is evident that many alterations, modifications, and variations will become apparent to those skilled in the art in light of the foregoing description. Accordingly, it is intended by the appended claims to embrace all such alternatives, modifications, and variations as fall within the spirit and broad scope of the invention.

We claim:

1. An RF absorbing, ablating apparatus comprising:

a body;

a transmission device being attached to said body;

a receiving device being attached to said body and spaced from said transmission device;

an ablating material including ethylenetetrofluoroethylene covering said transmission and receiving devices; and an RF absorbing ablator covering said body between said ablating material covering said transmission and receiving devices, said absorbing ablator including ethylenetetrofluoroethylene having an RF absorbing material mixed therewith.

2. The RF absorbing, ablating apparatus of claim 1 wherein said RF absorbing material is comprised of Carbonyl Iron Powder.

3. A method of preventing RF signals from being transmitted through an ablating material from a transmission antenna to a receiving antenna located on the surface of an airborne vehicle which comprises the steps of:

providing an RF absorbing material;

combining said RF absorbing material with an ablating material including ethylenetetrofluoroethylene forming an RF absorbing, ablating material;

placing said RF absorbing, ablating material between said transmission and receiving antenna; and placing ablating material including ethylenetetrofluoroethylene over said transmission and receiving antenna.

4. The method of claim 3 wherein said RF absorbing, ablating material is placed on a ground plane between said transmission and receiving antenna.

5. An RF absorbing, ablating apparatus comprising:

a body;

a transmission device being attached to said body;

a receiving device being attached to said body and spaced from said transmission device;

an ablating material covering said transmission and receiving devices, said ablating material being comprised of ethylenetetrofluoroethylene; and an RF absorbing ablator covering said body between said ablating material covering said transmission and receiving devices, said RF absorbing ablator comprising Carbonyl Iron.

* * * * *